United States Patent [19]

Mäkinen et al.

[11] Patent Number: 4,518,062

[45] Date of Patent: May 21, 1985

[54] PROCEDURE AND MEASURING CIRCUIT FOR STOPPING AN ELEVATOR

[75] Inventors: Heimo Mäkinen; Seppo Suur-Askola, both of Hyvinkää, Finland

[73] Assignees: Elevator GmbH, Baar, Switzerland; Kone Oy, Helsinki, Finland

[21] Appl. No.: 440,230

[22] PCT Filed: Mar. 4, 1982

[86] PCT No.: PCT/FI82/00009

§ 371 Date: Nov. 2, 1982

§ 102(e) Date: Nov. 2, 1982

[87] PCT Pub. No.: WO82/03068

PCT Pub. Date: Sep. 16, 1982

[30] Foreign Application Priority Data

Mar. 4, 1981 [FI] Finland ..... 810677

[51] Int. Cl.[3] ..... B66B 1/30

[52] U.S. Cl. ..... 187/29 R; 340/21; 340/669; 340/661; 307/354; 307/355

[58] Field of Search ..... 340/21, 661, 669; 307/350, 351, 352, 353, 354, 355, 356, 357, 358, 359; 187/29 R

[56] References Cited

U.S. PATENT DOCUMENTS

| | | | |
|---|---|---|---|
| 3,080,546 | 3/1963 | Deschamps et al. | 340/669 |
| 3,393,773 | 7/1968 | Rufli et al. | 318/401 X |
| 3,591,854 | 7/1971 | Cole | 307/355 X |
| 3,638,183 | 1/1972 | Progler et al. | 307/358 X |
| 3,697,782 | 10/1972 | Matouka | 307/354 |
| 3,785,463 | 1/1974 | Kuhl et al. | 187/29 R |
| 4,097,842 | 6/1978 | Zalar et al. | 340/669 X |
| 4,295,099 | 10/1981 | Evans | 307/351 X |
| 4,311,994 | 1/1982 | Kuribayashi | 340/661 |
| 4,362,996 | 12/1982 | Priebe | 307/351 X |
| 4,400,633 | 8/1983 | Mouri | 307/351 |

FOREIGN PATENT DOCUMENTS

| | | | |
|---|---|---|---|
| 8203068 | 9/1982 | Finland | 187/29 R |

*Primary Examiner*—William M. Shoop
*Assistant Examiner*—Paul Shik Luen Ip

[57] ABSTRACT

A procedure for adjusting the stopping of an elevator as accurately as possible on desired level with the aid of the deceleration instruction (DR). From the elevator's deceleration instruction (DR) a sample is taken at the beginning and at the end of deceleration, these are compared with each other and the linearity of deceleration is adjusted on the basis of the result obtained. The invention also concerns an elevator deceleration measuring circuit for carrying out the procedure. The measuring circuit, connected to the deceleration instruction (DR) of the elevator, comprises a display unit such as for instance two light-emitting diodes (D4,D5) by which the result can be ascertained if the deceleration instruction is increasing or decreasing.

3 Claims, 1 Drawing Figure

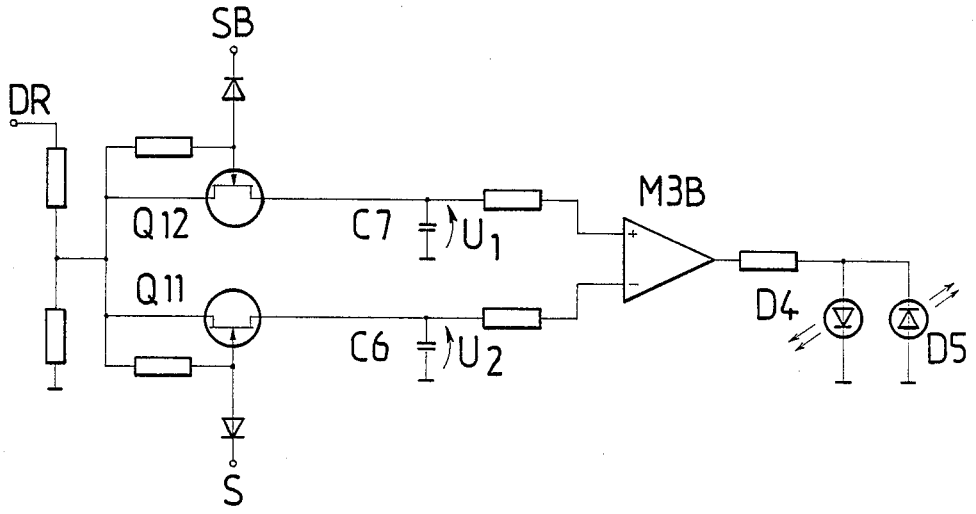
SB
DR
Q12
Q11
C7
C6
U1
U2
M3B
D4
D5
S

PROCEDURE AND MEASURING CIRCUIT FOR STOPPING AN ELEVATOR

BACKGROUND OF THE INVENTION

The present invention concerns a procedure for adjusting the stopping of an elevator with highest possible accuracy on desired level with the aid of the deceleration instruction.

In prior art the adjustment has been accomplished in that the elevator is adjusted to stop by stopping distance control with highest possible accuracy on the level. The stopping error from both directions is measured. The linearity control is empirically adjusted more or less, depending on the feel of the installer. The stopping error in both directions is measured. If the sum of the stopping errors is less than the error found before, then the adjustment was made in the correct direction. If the direction of adjustment is wrong, the linearity adjustment is returned to its initial value and adjustment is continued in the opposite direction until the sum of the stopping errors is less. The stopping distance is readjusted, and this also effects the linearity. The linearity is readjusted as above.

Drawbacks of this mode of adjustment:

time consuming;

indefinite, therefore difficult to set up the adjustment instruction;

requires an experienced fitter for good results;

owing to uncertainty, a recorder is often needed.

The object of the present invention is to eliminate the drawbacks mentioned. The procedure of the invention is characterized in that from the deceleration instruction of the elevator a sample is taken at the beginning and end of deceleration, these are compared with each other and on the basis of the result thus obtained the linearity of deceleration is adjusted.

The invention also concerns a measuring circuit for carrying out the procedure.

BRIEF SUMMARY OF THE INVENTION

The measuring circuit of the invention is characterized in that the measuring circuit, connected to the deceleration instruction of the elevator, comprises a display means such as two light-emitting diodes for instance, by which the result can be ascertained if the deceleration instruction is increasing or decreasing. The measuring circuit is simple and when added in conjunction with the electronic circuit boards of the elevator, it is exceedingly inexpensive and requires minimal space. The measuring circuit eliminates the need of the fitter team to carry a recorder (the recorder is quite expensive). The invention makes the linearity adjustment faster and simpler because the instrument gives exact indication with the aid of LED diodes when the adjustment is correct. Since the result of adjustment is no longer dependent on the installer's experience and training, the possibility of incorrect adjustment is less. An error of linearity directly causes an error in the stopping accuracy of the elevator.

One embodiment of the invention is characterized in that the measuring circuit comprises two memories, such as two capacitors for instance, both being charged under control by switches depending on whether the stopping instruction is increasing or decreasing.

BRIEF DESCRIPTION OF THE DRAWING

The invention is described in the following with the aid of an example and with reference to the attached drawing, presenting an elevator deceleration measuring circuit.

DETAILED DESCRIPTION OF THE PREFERRED EMBODIMENT

The signals Sb, or start-of-deceleration information, and S, or remaining distance to the level, are positive (+15 V) when the elevator is accelerating and when it is running with rated speed. On commencement of deceleration the signal SB changes to be negative (−15 V) and the switch Q12 closes. The value which the deceleration instruction DR has at that moment remains stored in the capacitor C7—voltage $U_1$. If the decelerating instruction is decreasing, as has been assumed in this example, the capacitor C6 is charged to a lower voltage $U_2$ when the switch Q11 closes. The signal S becomes negative when the remaining distance to the level is less than 7 cm. M3B compares the voltages $U_1$ and $U_2$. In the case now in hand, the output of M3B assumes a negative value (−15 V) because $U_2$ is more strongly positive, and the LED D5 is lighted.

Since the operation amplifier M3B has high input impedances, the voltages $U_1$ and $U_2$ are retained in memory a certain time, thus giving a chance to read the instrument without hurry.

The adjustment is now accomplished as follows.

The elevator is adjusted to stop as accurately as possible with the stopping distance control.

The elevator is run both upward and downward and the LED diodes are consulted as to the direction in which the linearity is adjusted.

The above is repeated until the LED diodes indicate that the adjustment is correct.

The stopping distance is readjusted.

It is obvious to a person skilled in the art that different embodiments of the invention may vary within the scope of the claims following below.

We claim:

1. Procedure for adjusting the stopping of an elevator as accurately as possible by adjustment of deceleration linearity on desired level with the aid of a deceleration instruction (DR), characterized in that the elevator is run both upward and downward; comprising sampling the elevator's deceleration instruction at the beginning and end of deceleration, comparing said samples, and adjusting the linearity of said deceleration instruction based on said sampling.

2. A procedure according to claim 1, wherein the elevator includes a measuring circuit connected to the deceleration instruction (DR) of the elevator and comprises a display unit including two light emitting diodes responsive to the deceleration instruction; and wherein said step of comparing includes the step of observing said light emitting diodes (D4, D5) to ascertain if the deceleration instruction is increasing or decreasing.

3. A procedure according to claim 2 wherein the measuring circuit comprises two memories and wherein said step of sampling further comprises the step of storing samples in each of said memories by means of switches which are operable depending on whether the deceleration instruction is increasing or decreasing.

* * * * *